US007322552B1

(12) United States Patent
Lin

(10) Patent No.: US 7,322,552 B1
(45) Date of Patent: Jan. 29, 2008

(54) CURTAIN ROD SUPPORT

(76) Inventor: Wen-Jui Lin, No. 202-10, Yuetan Chun, Singang Hsiang, Chia Yi Hsien (TW)

( * ) Notice: Subject to any disclaimer, the term of this patent is extended or adjusted under 35 U.S.C. 154(b) by 0 days.

(21) Appl. No.: 11/512,291

(22) Filed: Aug. 30, 2006

(51) Int. Cl.
*A47H 1/14* (2006.01)

(52) U.S. Cl. ..... 248/252; 248/254; 248/255; 160/89

(58) Field of Classification Search ..... 248/252, 248/254, 255, 253, 263, 266, 267, 264, 251; 160/89, 902
See application file for complete search history.

(56) References Cited

U.S. PATENT DOCUMENTS

| | | | | | |
|---|---|---|---|---|---|
| 932,684 | A | * | 8/1909 | Depp | 248/254 |
| 934,676 | A | * | 9/1909 | Langslow | 211/119.005 |
| 1,095,551 | A | * | 5/1914 | Collier | 248/255 |
| 1,116,173 | A | * | 11/1914 | Uffelman | 248/252 |
| 1,346,749 | A | * | 7/1920 | Henson | 248/254 |
| 2,225,281 | A | * | 12/1940 | Speranza | 248/253 |
| 2,293,662 | A | * | 8/1942 | Richardson | 160/19 |
| 2,412,059 | A | * | 12/1946 | Pinto | 248/263 |
| 2,484,855 | A | * | 10/1949 | Press | 248/253 |
| 2,506,160 | A | * | 5/1950 | Martin et al. | 248/255 |
| 2,508,737 | A | * | 5/1950 | Zeto | 248/263 |
| 2,738,154 | A | * | 3/1956 | Mason | 248/255 |
| 2,902,243 | A | * | 9/1959 | Atwood | 248/253 |
| 3,734,440 | A | * | 5/1973 | Hoare | 248/265 |
| 3,889,912 | A | * | 6/1975 | Ray | 248/255 |
| 4,284,258 | A | * | 8/1981 | Kleiman | 248/251 |
| 4,684,095 | A | * | 8/1987 | Athey | 248/255 |

* cited by examiner

*Primary Examiner*—Kimberly Wood
(74) *Attorney, Agent, or Firm*—Rosenberg, Klein & Lee

(57) ABSTRACT

A curtain rod support includes a bracket having a top plate, securing holes and an extension extending downward from a bottom face of the top plate, a hook having positioning holes aligned with the securing holes in the top plate to allow two bolts to extend through the aligned securing holes and the positioning holes to secure engagement between the bracket and the hook and a bend formed on a distal end thereof receivable therein a first curtain rod and a base having two arms extending upward from a base and a connecting hole defined through the base so that a second threaded rod is extended through the connecting hole and into the extension to secure engagement between the seat and the bracket such that a second curtain rod is receivable inside a receiving space between the base and a bottom face of the hook.

3 Claims, 7 Drawing Sheets

CURTAIN ROD SUPPORT

BACKGROUND OF THE INVENTION

1. Field of the Invention

The present invention relates to a curtain rod support, and more particularly to a curtain rod support for both a roman shade and a crisscross curtain.

2. Description of the Prior Art

As a known fact in the art, there are generally two different kinds of curtains, depending on the operating direction of the curtain, one is called the roman shade or the roll-up blind and the other is called the crisscross curtain. The roman shade or the roll-up blind has a curtain rod supported by a curtain rod support which is provided at both ends of the curtain rod. Because the shade cloth for the roman shade or the lath for the roll-up blind does not move sideward but only up and down relative to the curtain rod, the curtain rod plays a role to support the weight of the curtain cloth or the lath. In addition, the curtain rod has a rectangular shape in cross section.

The crisscross curtain also has a curtain rod which provides a track for movement of rollers inside the track. Due to the provision of the rollers, curtain cloth securely connected to each of the rollers is divided to two halves, one is moving from the left to the right of the curtain rod and the other half is moving from the right to the left. The curtain rod of the crisscross curtain has a circular shape in cross section.

The curtain rod support for the roman shade or the roll-up blind is not interchangeable with the curtain rod support for the crisscross curtain because of the shape configuration of the curtain rod supports. However, as a decorative purpose and functional purpose, customers often have two different curtains, namely the roman shade and the crisscross curtain, in the living rooms. As such, the customers have to purchase two different curtain rod supports for different types of curtains. It is not only a waste of money, but also a waste of labor for installation of the curtain rod supports of different configurations.

To overcome the shortcomings, the present invention tends to provide an improved curtain rod support to mitigate the aforementioned problems.

SUMMARY OF THE INVENTION

The primary objective of the present invention is to provide an improved curtain rod support to adapt for both the roman shade and the crisscross curtain.

In order to accomplish the aforementioned objective, the curtain rod support of the present invention includes a bracket, a hook securely connected to the bracket and a seat securely connected to the bracket. The hook has a bend formed on a free end thereof for receiving therein a curtain rod of a crisscross curtain. A receiving space is defined between the bracket and the seat after the seat is securely connected to the bracket such that a curtain rod for a roman shade or a roll-up blind is receivable inside the receiving space. Therefore, there is only one curtain rod support necessary for both the roman shade and the crisscross curtain.

Other objects, advantages and novel features of the invention will become more apparent from the following detailed description when taken in conjunction with the accompanying drawings.

DETAILED DESCRIPTION OF THE PREFERRED EMBODIMENT

Figure 1:
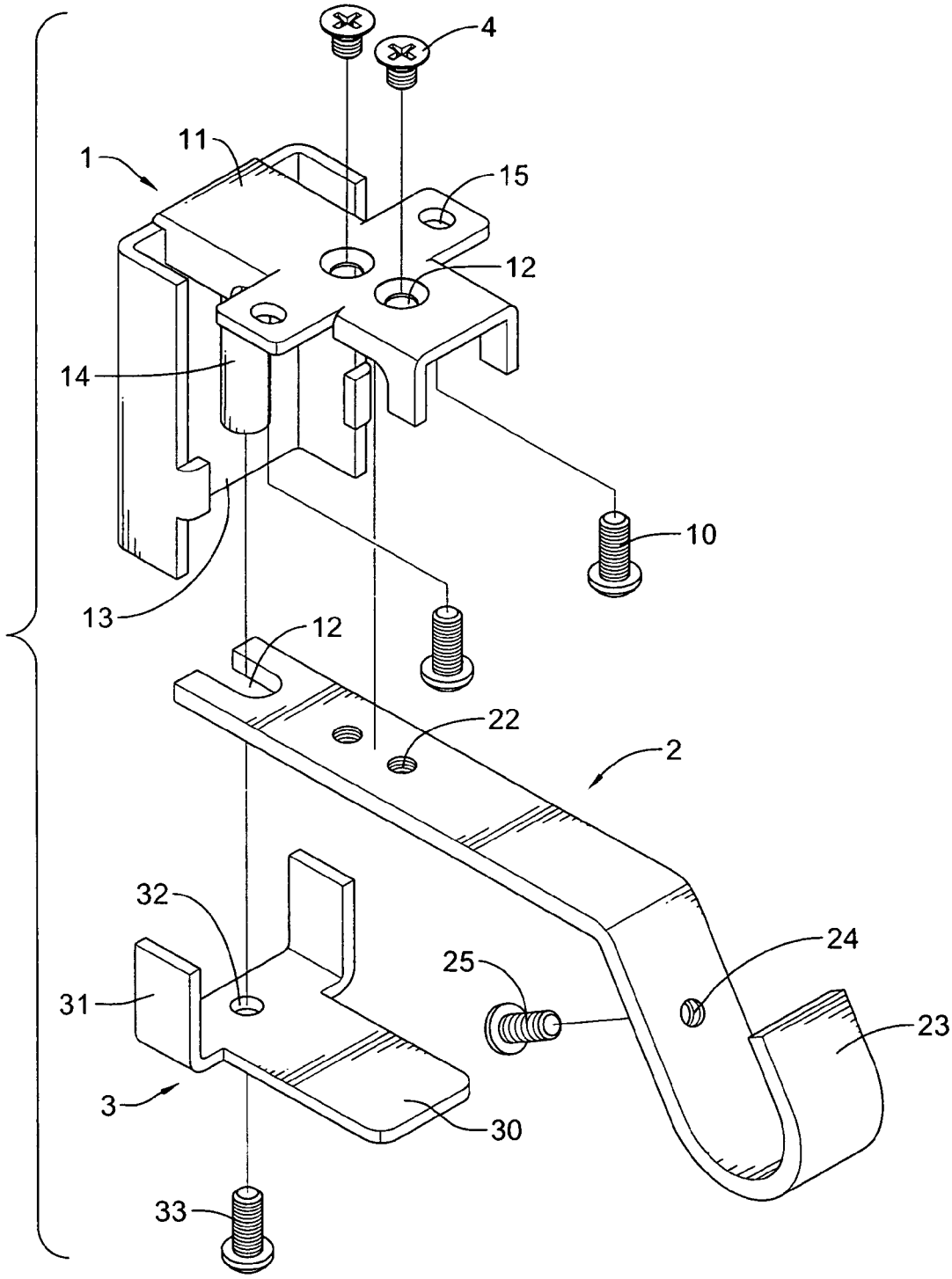
FIG. 1 is an exploded perspective view of the curtain rod support of the present invention.

With reference to FIG. 1, it is noted that the curtain rod support in accordance with the present invention includes a bracket (1), a hook (2) and a seat (3).

The bracket (1) of the present invention is provided with a top plate (11) for a secured engagement with a ceiling or a wall (not shown), securing holes (12) defined through the top plate (11), a U shaped engagement wall (13) formed on a free end of the top plate (11) and an extension (14) extending downward from a bottom face of the top plate (11). Two first threaded bolts (10) are provided to the bracket (1) to extend through the top plate (11) to allow the top plate (11) to securely engage with the ceiling or the wall. In addition, an extension (14) is extending downward from the bottom face of the top plate (11).

The hook (2) has a cutout (21) defined in a proximal end of the hook (2) to receive therein the extension (14) of the bracket (1), two positioning holes (22) to align with the two securing holes (12) of the top plate (11) and a bend (23) formed on a distal end thereof. A threaded hole (24) is defined in a side face of the bend (23) to allow extension of a second threaded bolt (25).

The seat (3) has two arms (31) extending upward from a base (30) and a connecting hole (32) defined through the base (30) to allow extension of a third threaded bolt (33) into the extension (14) of the bracket (1).

Figure 2:
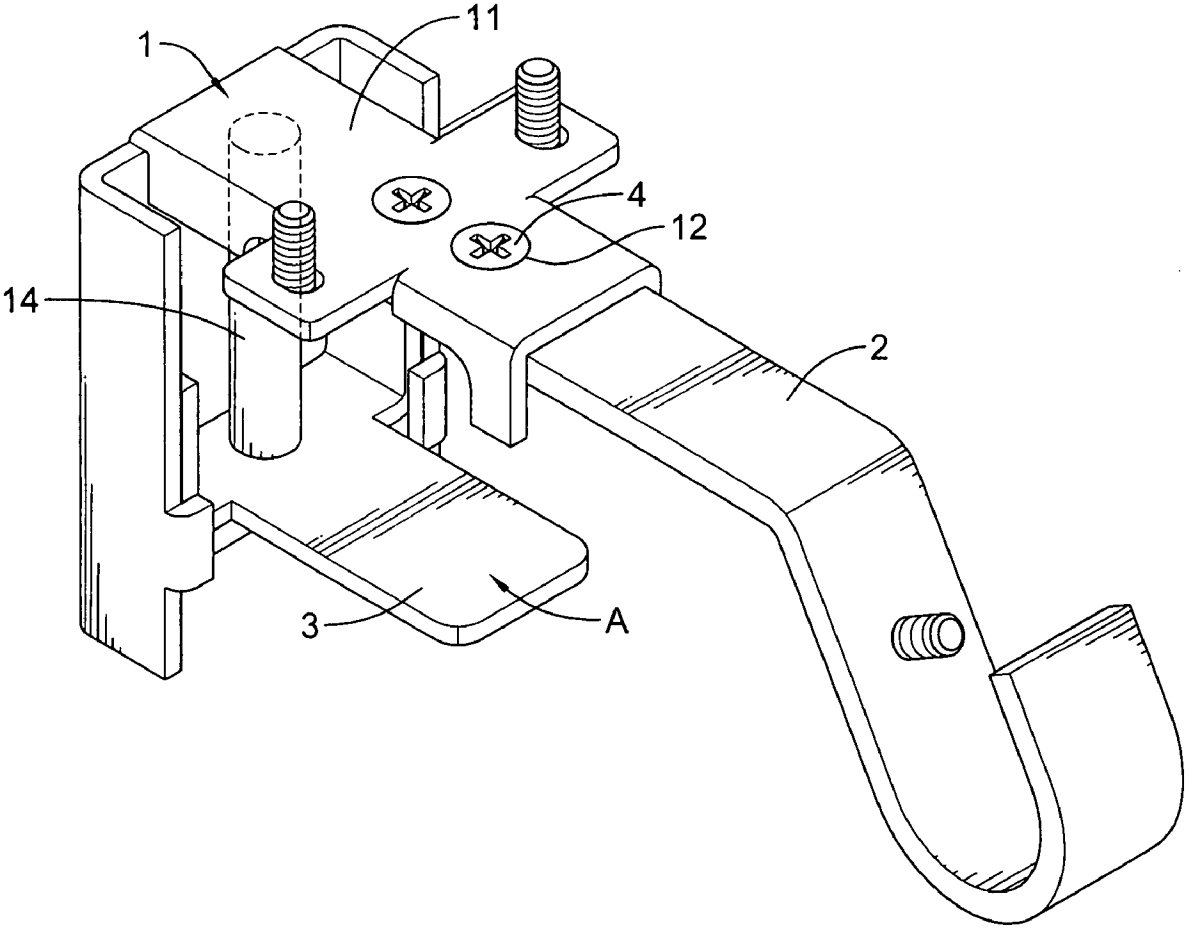
FIG. 2 is a perspective view of the curtain rod support in assembly.

With reference to FIG. 2, it is noted that when the curtain rod support of the present invention is assembled, the hook (2) is inserted into the bracket (1) with the extension (14) received in the cutout (21) of the hook (2) and the two positioning holes (22) aligned with the two securing holes (12). Thereafter, two bolts (4) are respectively inserted into the aligned securing holes (12) and the positioning holes (22) to secure engagement of the hook (2) to the top plate (11). Then the third threaded bolt (33) is extended through the connecting hole (32) of the seat (3) and into the extension (14) to secure engagement between the seat (3) and the bracket (1). The second threaded bolt (25) is threadingly extended into the threaded hole (24) of the hook (2). Finally the two first threaded bolts (10) are extended through two holes (15) in the top plate (11) to secure the bracket (1) to a ceiling or a wall.

Figure 3:
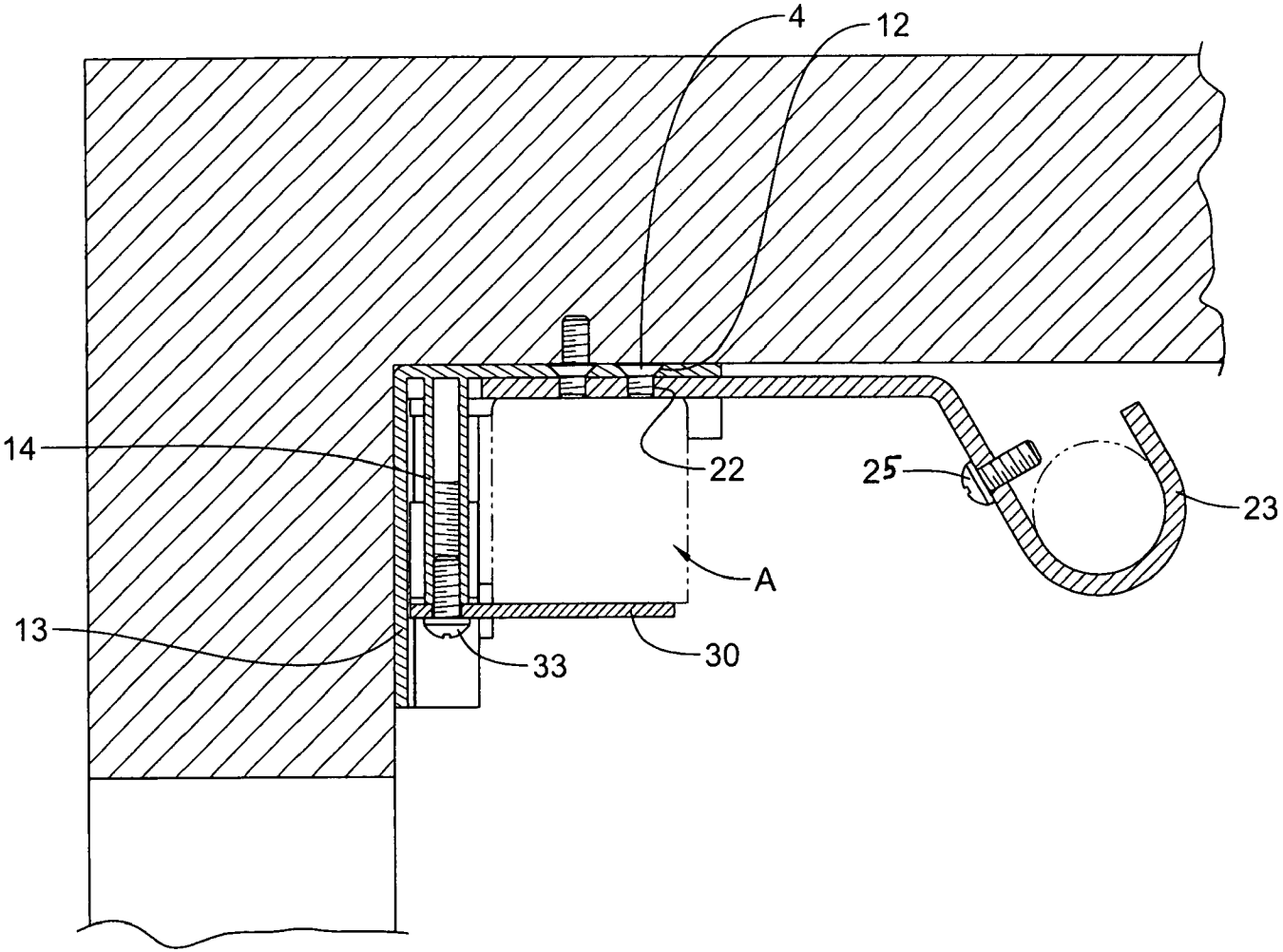
FIG. 3 is a schematic cross sectional view showing the adaptation of the curtain rod support of the present invention for both the roman shade and the crisscross curtain.
Figure 4:
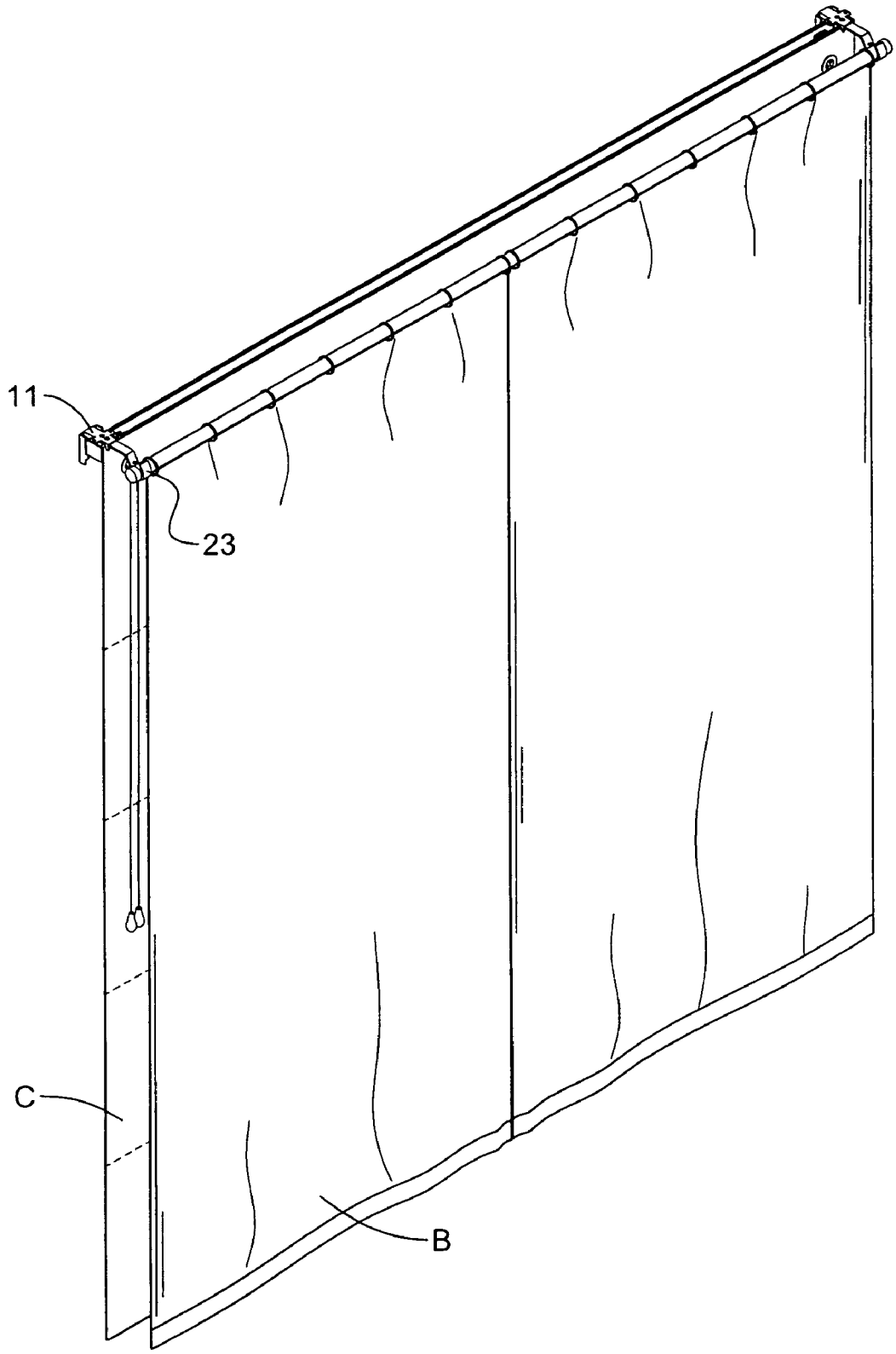
FIG. 4 is a perspective view showing that the roman shade and the crisscross curtain are adapted to be hung on the curtain rod support of the present invention.
Figure 5:
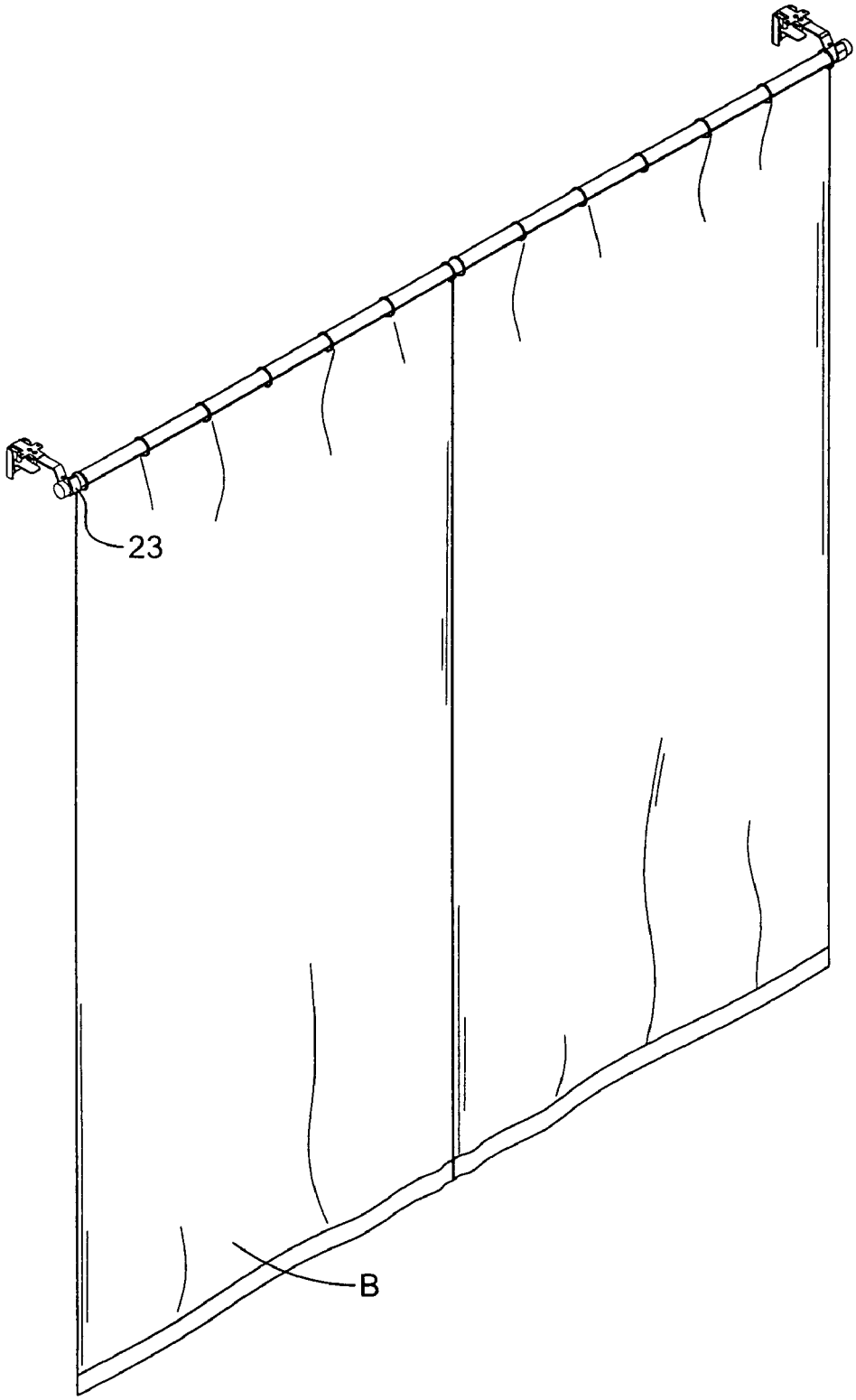
FIG. 5 is a perspective view showing that the crisscross curtain is adapted to the curtain rod support of the present invention.
Figure 6:
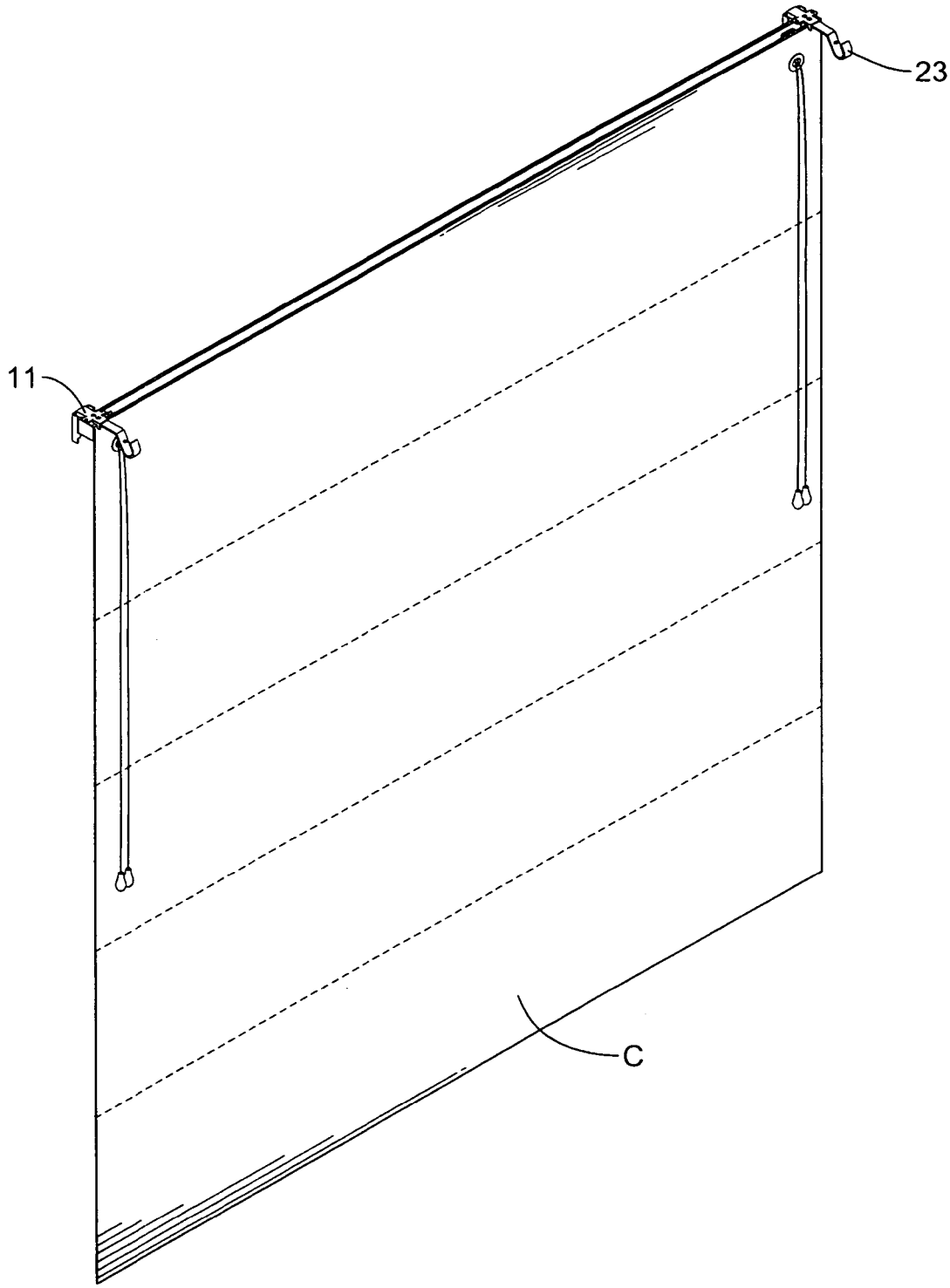
FIG. 6 is a perspective view showing that the roman shade is adapted to the curtain rod support of the present invention.
Figure 7:
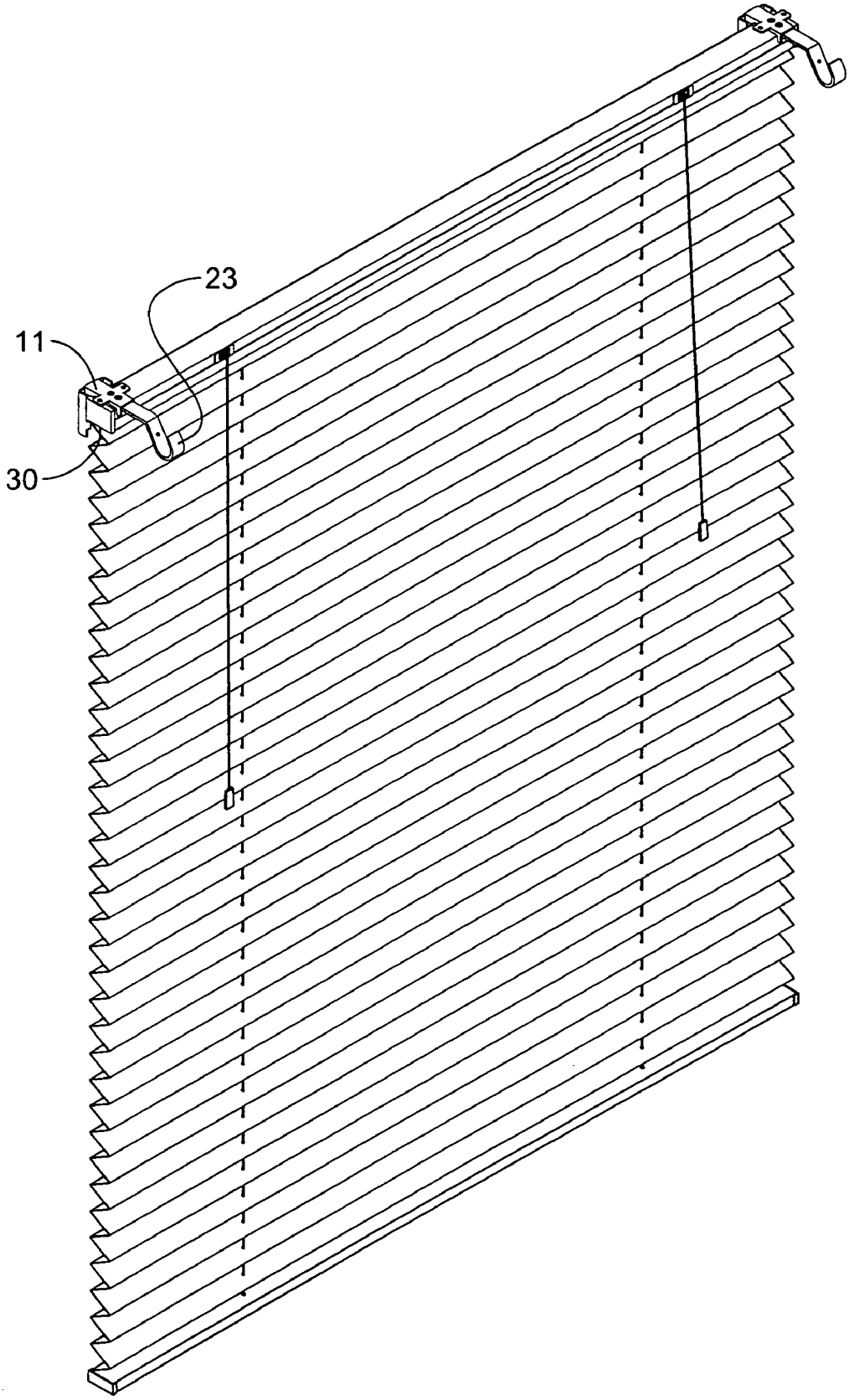
FIG. 7 is a perspective view showing that the venetian blind is adapted to the curtain rod support of the present invention.

It is noted from FIGS. 2 and 3 that due to the provision of the extension (14), a receiving space (A) is defined between the seat (3) and the bracket (1) for receiving therein a rectangular curtain rod for a roman shade or a roll-up blind. Furthermore, after the second threaded bolt (25) is extended into the threaded hole (24), the second threaded bolt (25) functions as a stop to prevent movement of a curtain rod for a crisscross curtain.

From the depiction of FIGS. 4, 5, 6 and 7, it is noted that the user is able to use the curtain rod support of the present invention to simultaneously support a roman shade (B) and a crisscross curtain (C). The roman shade (B) or the roll-up blind (not numbered) may be hung solely on the curtain rod support of the present invention as long as the curtain rod for such curtains is circular. As for a venetian blind, it is noted that since the blind rod is rectangular shape, the blind rod is snugly received in the receiving space between a bottom face of the hook (2) and the base (30). As a conclusion, it is noted that the curtain rod support of the present invention satisfies different kinds of curtain rods.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A curtain rod support consisting essentially of:

a bracket having a top plate provided with securing holes defined through the top plate, a U shape engagement wall formed on a proximal end of the top plate, an extension extending downward from a bottom face of the top plate and holes defined through the top plate to receive two first threaded bolts for engagement with a wall;

a hook having positioning holes aligned with the securing holes in the top plate to allow two bolts to extend through the aligned securing holes and the positioning holes to secure engagement between the bracket and the hook and a bend formed on a distal end thereof receivable therein a first curtain rod; and a seat having two arms extending upward from a base and a connecting hole defined through the base so that a second threaded rod is able to extend through the connecting hole and into the extension to secure engagement between the seat and the bracket such that a second curtain rod is receivable inside a receiving space defined between the base and a bottom face of the hook.

2. The curtain rod support as claimed in claim 1, wherein a threaded hole is defined in a side face of the bend and a third threaded bolt is extended into the threaded hole to function as a stop for prevention of movement of the first curtain rod received in the bend.

3. The curtain rod support as claimed in claim 1, wherein a cutout is defined in a proximal end of the hook to receive therein the extension of the bracket.

* * * * *